United States Patent [19]

Cox

[11] 4,266,351

[45] May 12, 1981

[54] CENTER PLOW FOR RAILROAD BALLAST

[75] Inventor: Emmett W. Cox, West Columbia, S.C.

[73] Assignee: Canron Corporation, West Columbia, S.C.

[21] Appl. No.: 83,947

[22] Filed: Oct. 11, 1979

[51] Int. Cl.[3] ..... E01B 27/04

[52] U.S. Cl. ..... 37/104

[58] Field of Search ..... 104/2, 5, 279; 37/104, 37/105

[56] References Cited

U.S. PATENT DOCUMENTS

| | | | |
|---|---|---|---|
| 3,020,853 | 2/1962 | Christoff | 37/104 |
| 3,877,160 | 4/1975 | Plasser et al. | 37/104 |

FOREIGN PATENT DOCUMENTS

| | | | |
|---|---|---|---|
| 2754156 | 7/1979 | Fed. Rep. of Germany | 37/104 |

*Primary Examiner*—Richard A. Bertsch

*Attorney, Agent, or Firm*—Wenderoth, Lind & Ponack

[57] ABSTRACT

There is described a railroad ballast plow comprising a four element plow member of substantially X-shaped configuration mounted on subframes on a track travelling vehicle so that it can be moved vertically into and out of engagement with the ballast. The elements are disposed such that the intersection point of the X is central of the track and the elements are positioned in pairs on the sub-frames so as to provide a leading and a trailing plow element on each side of the machine. Each plow element has, at an end adjacent the intersection point of the X, a ballast passing gate hinged adjacent and along an upper edge of its respective plow member for rotation between open and closed position. Each ballast passing gate is individually operated by a remote controlled hydraulic piston and cylinder arrangement located between a gate and its respective sub-frame.

6 Claims, 7 Drawing Figures

CENTER PLOW FOR RAILROAD BALLAST

BACKGROUND OF THE INVENTION

It is known in the art to provide ballast plow devices on ballast plow machines which devices are capable of moving ballast in either direction of track travel of the machine to perform such functions as transferring ballast which has been dumped centrally of the track towards the outside thereof, or to move ballast from one track shoulder across the track to the other, however the more versatile the plow devices have become the more complex they have become. The present invention provides a simple plow of high versatility.

SUMMARY OF THE INVENTION

According to the present invention there is provided a railroad ballast plow comprising a four element plow member of substantially X-shaped configuration mounted to be centrally of the track on a track travelling vehicle for vertical movement into and out of engagement with the ballast, each plow element having at its end adjacent the intersection point of the X a ballast passing gate, and means to individually open and shut each of the four gates.

In a preferred embodiment the plow elements are mounted beneath the vehicle in pairs on vertically movable sub-frames providing a leading and a trailing plow element on each side of the vehicle.

Preferably also, each ballast passing gate is hinged adjacent and along an upper edge of its respective plow element for rotation between open and closed positions. Each plow element advantageously, has at its end remote from the intersection of the X, a flap rotatable in a horizontal plane about a vertical hinge line. This flap may also have an outer tip rotatable on the flap in a vertical plane about a horizontal pivot on the flap.

Conveniently the means for individually opening and shutting each of the gates comprises a remote controlled power means operatively connected between a gate and its respective sub-frame.

DESCRIPTION OF THE DRAWINGS

The following is a description by way of example of one embodiment of the invention reference being had to the accompanying drawings in which.

DESCRIPTION OF THE PREFERRED EMBODIMENT

A self-propelled ballast plow machine 10 has a main chasis 11 mounted on pairs of front and rear track engaging wheels 12 and 13.

Figure 1:
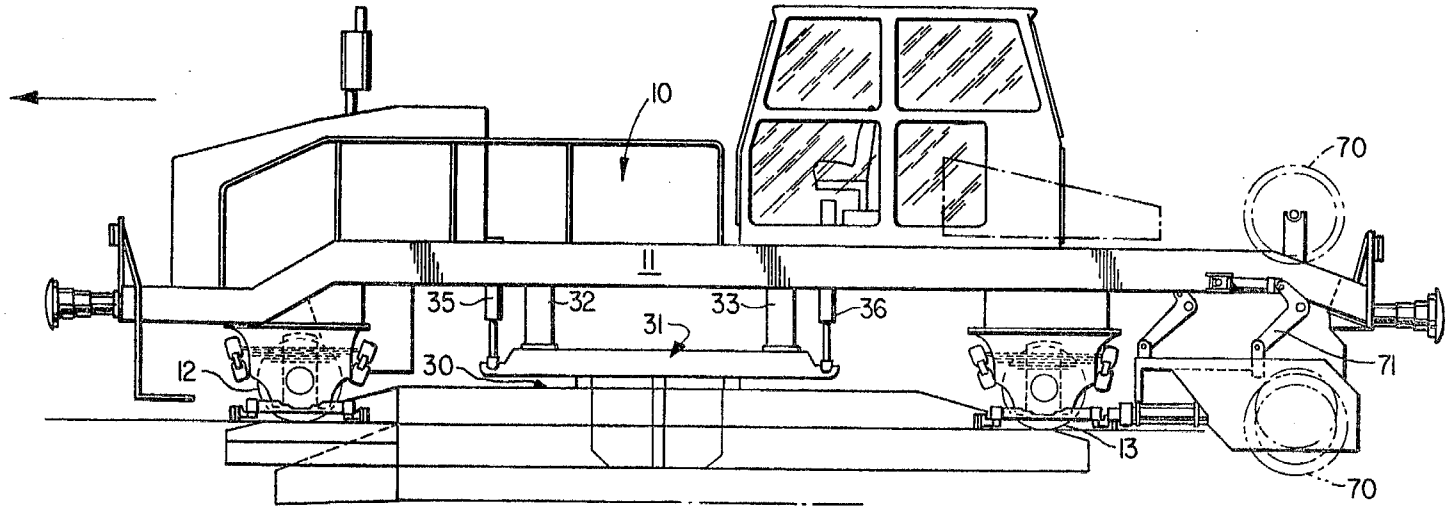
FIG. 1 is a side elevation schematic of a railroad ballast plow machine.
Figure 2:
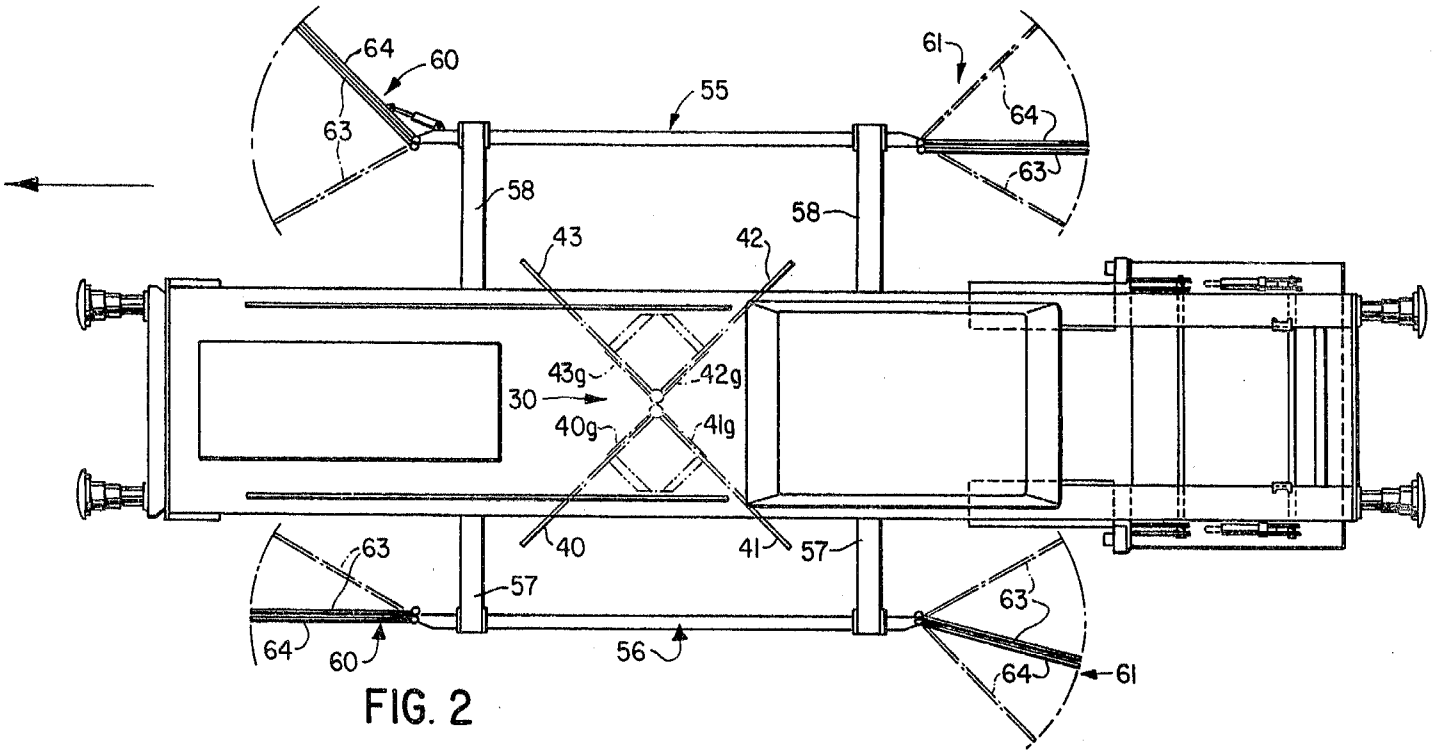
FIG. 2 is a diagrammatic plan view of the machine showing a pair of side plows with which the device of the invention may conveniently operate.

As shown generally in FIGS. 1 and 2, a centre plow 30 is mounted centrally of and beneath chassis 11 of the machine on a sub-frame assembly 31. The sub-frame assembly 31 comprises two sub-frames 31*a*, 31*b* (see FIG. 3) each of which is raisable and lowerable vertically on guides 32,22, into and out of engagement with the ballast under the action of hydraulic piston and cylinder arrangements 35,36.

Figure 3:
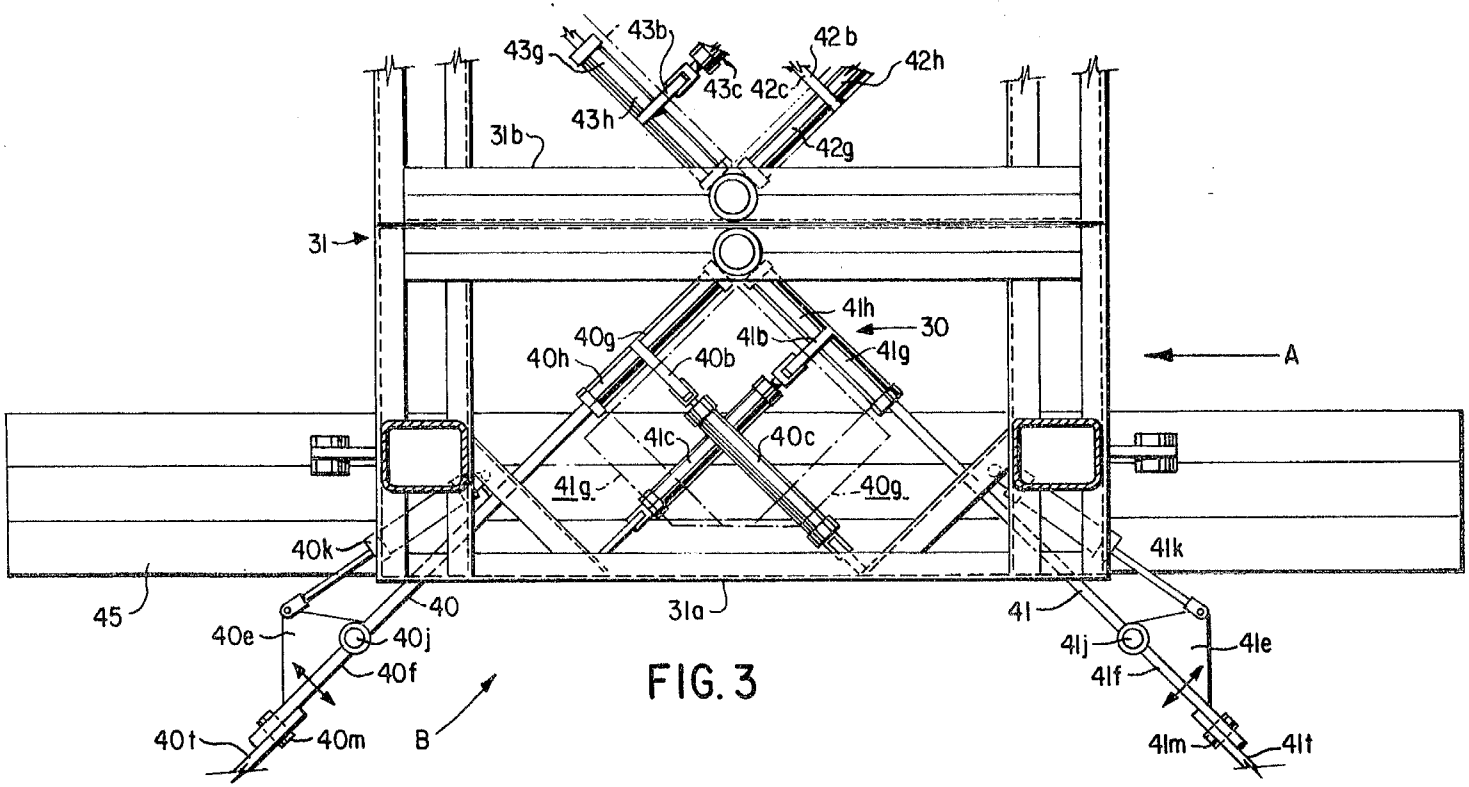
FIG. 3 is a partial plan view showing the plow.
Figure 6:
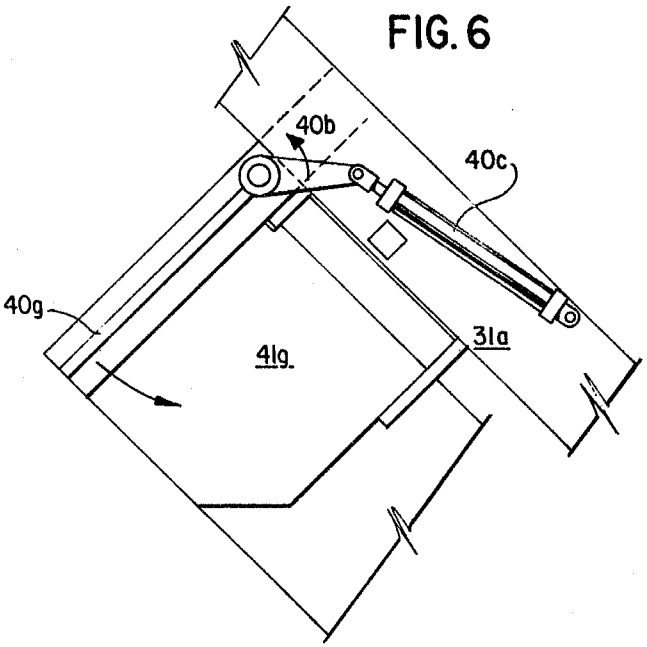
FIG. 6 is a detail looking in the direction of the arrow B in FIG. 3.

Turning now more particularly to FIGS. 3, 4, 5 and 6 it will be seen that the centre plow 30 comprises four identical plow elements 40, 41, 42, 43 arranged when viewed in plan in a substantially X configuration. (see also FIG. 2). Two of the plow elements 40,41 are mounted on one sub-frame 31*a* whilst the other two plow elements 42 and 43 are mounted on the second sub-frame 31*b*. The plow elements are disposed on the sub-frames 31*a*,31*b* such that the plow element 40 provides a leading plow element and the element 41 provides a trailing plow element for one side of the machine and the elements 43 and 42 provide leading and trailing elements for the opposite side of the machine. Each pair of elements 40,41 and 42,43 are rigidly attached to and carry a longitudinally extending rail spanning tunnel 45 of conventional configuration. Each tunnel 45 is raised out of and lowered into spanning relationship with rail R when its associated plow pair is raised and lowered from the ballast. Each of the elements 40, 41, 42 and 43 has a ballast passing gate 40*g*, 41*g*, 42*g* and 43*g* and each one of the gates is pivoted about a respective hinge 40*h*, 41*h*, 42*h* and 43*h* extending adjacent and along the line of the top of the plow element. As best seen in FIGS. 3 and 6 the gates are individually operated by hydraulic cylinders 40*c*, 41*c*, 42*c* and 43*c* which are remotely controlled from the operator's cab on the machine. The cylinders extend between the gates and the sub-frame upon which the gates are mounted.

Turning particularly to FIG. 6 which shows the operating mechanism for the gate 40*g*. (Since all four gates are operated in identical fashion it is considered necessary to discuss only one of them in detail). The gate 40*g* carries a bell crank lever 40*b* at the upper end thereof and this bell crank lever 40*b* is connected to a clevis on the piston rod of the piston and cylinder arrangement 40*c* which in turn is connected to the frame 31*a*. Extension of the piston rod rotates the bell crank lever 40*b* and moves the gate 40*g* upwardly in the direction of the arrow. Retraction of the piston rod moves the gate 40*g* downwardly to the closed position. The gates 40*g* and 41*g* are shown in their raised position in dotted lines in FIG. 3.

Figure 4:
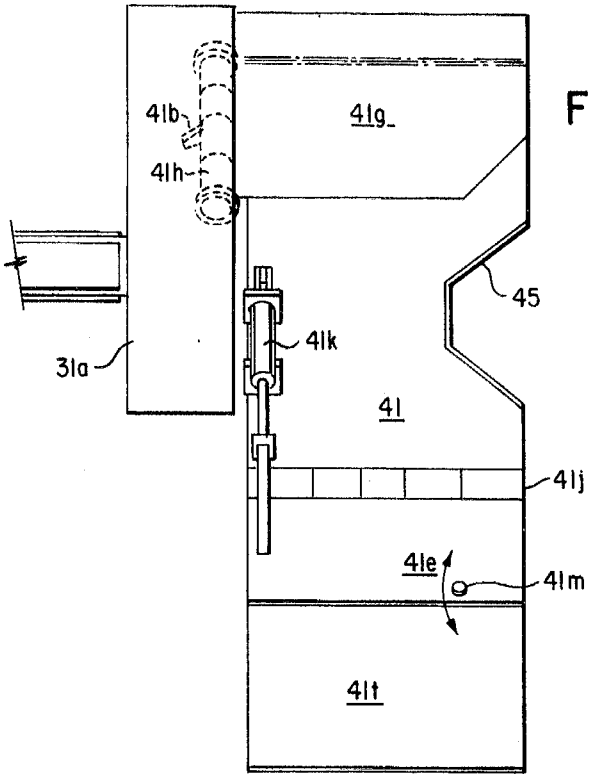
FIG. 4 is a partial view looking in the direction of arrow A in FIG. 3 and showing one plow element.
Figure 5:
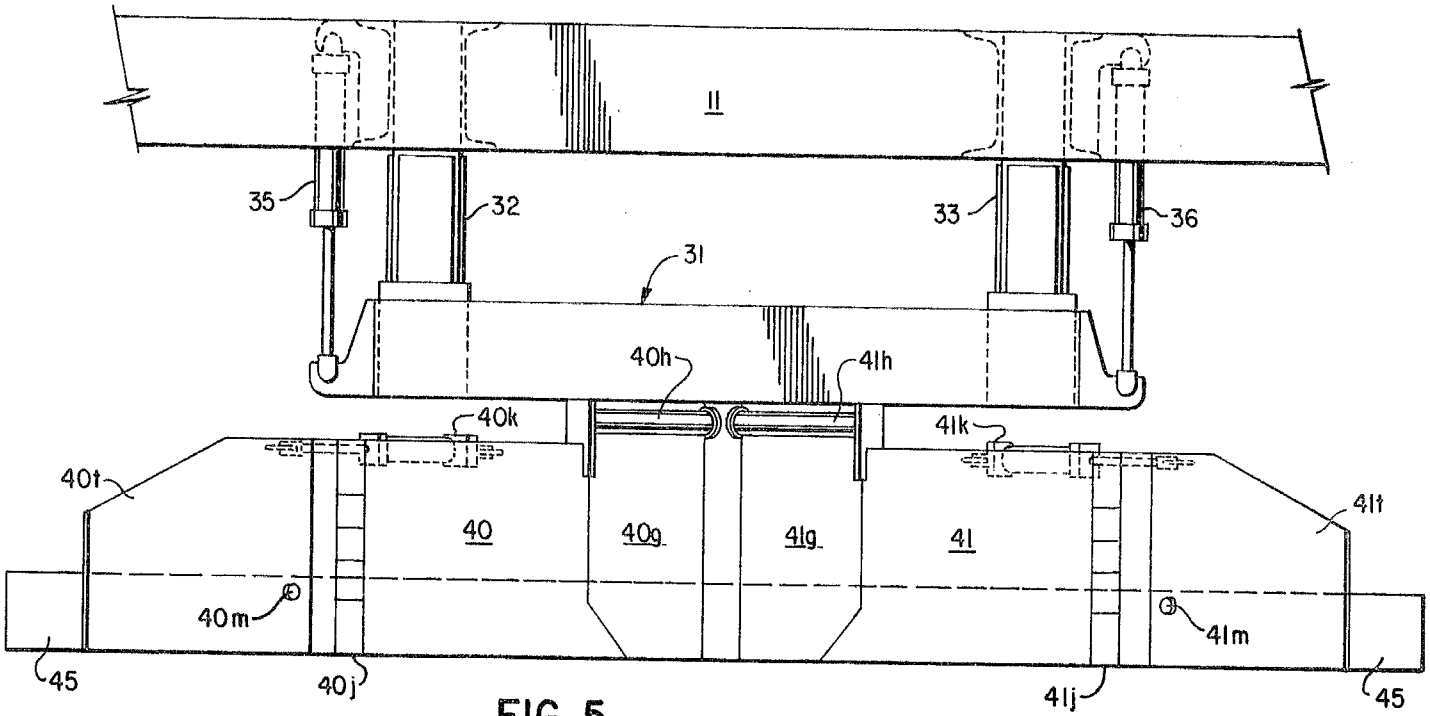
FIG. 5 is a partial side elevation showing two plow elements mounted on a sub-frame.

At the ends 40*e*, 41*e* of the plow elements 40 and 41 (and similarly, though not shown, for the elements 42 and 43) are mounted flaps 40*f* and 41*f* on vertical hinges 40*j*,41*j*. The flaps swing in the horizontal plane of the paper about their vertical hinges under the action of hydraulic cylinders 40*k*,41*k*. Where it is desired, the flaps 40*f*,41*f* may be split and provided with tips 40*t*,41*t* which are pivotable about horizontal pivots 40*m*,41*m* in a vertical plane, as best seen in FIG. 4.

Figure 7:
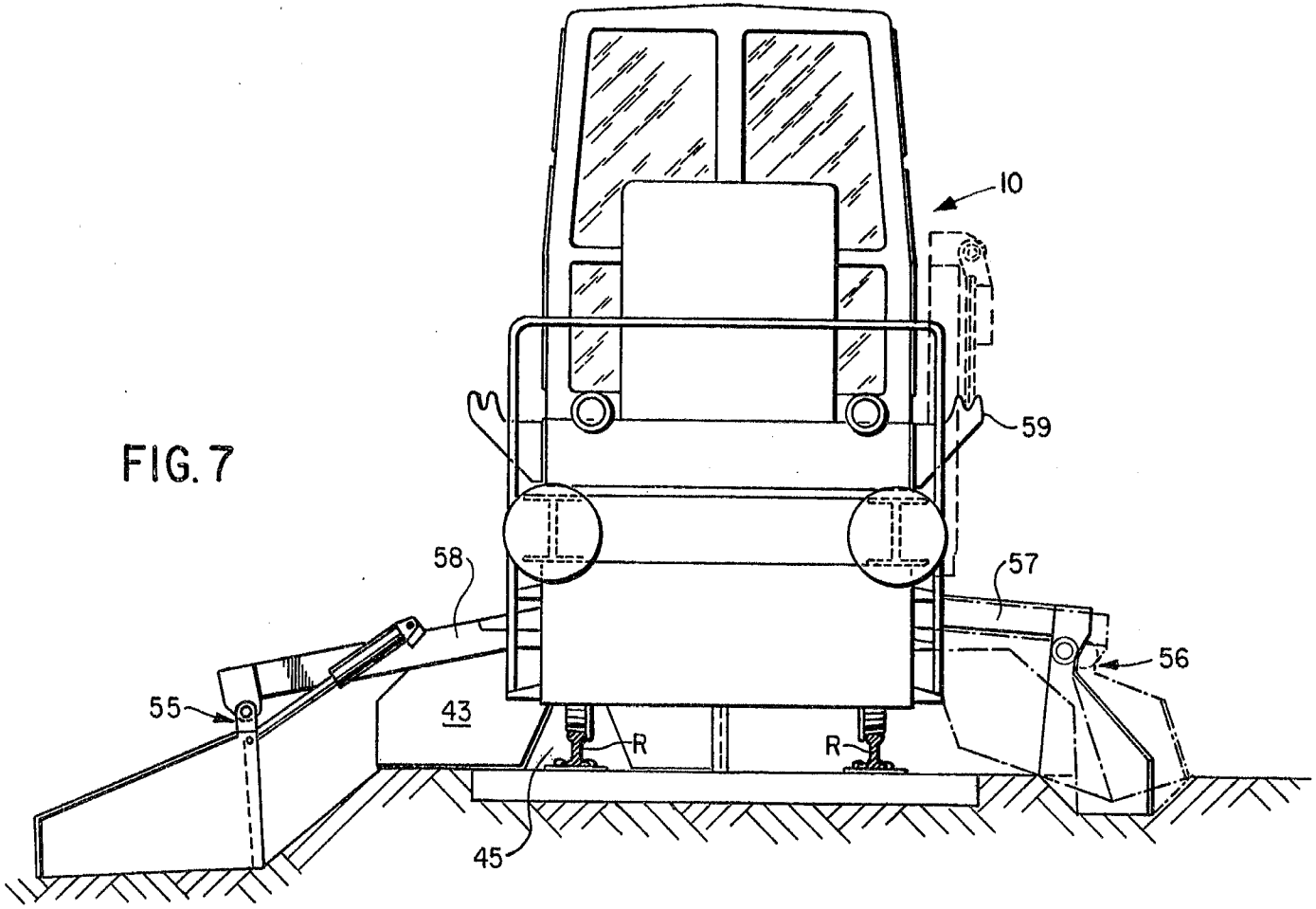
FIG. 7 is an end view looking along the direction of the track and showing parts of the plow device.

Turning now to FIGS. 2 and 7 a pair of side plow members 55 and 56 are telescopically mounted on beams 57 and 58 so that they may be spaced from the machine 10 at either side of the track at different distances. The side plows may be folded up alongside the machine 10 for track travel as shown in dotted lines in FIG. 7 and locked in retaining frames 59 during travel. The side plow members have leading and trailing wing members 60 and 61 each of which comprises an inner and outer flap 63 and 64 individually adjustable into a plurality of configurations. Such a side plow is described in co-pending U.S. application Ser. No. 83,945 filed Oct. 11, 1979, inventor George Robert Newman, the disclosure of which is incorporated hereinto by reference. It is to be understood that the side plow 55,56 shown herein is simply to indicate that the plow device which is the subject matter hereof may be used advantageously with side plow members and it is to be understood that the side plow member shown, is illustrative only and that, if desired to provide a side plow at all, any form of side plow capable of cooperating with the center plow 30 could be utilized.

In operation with or without the side plows 55,56 a large variety of operations can be performed by the centre plow 30. Certain exemplary operations will be described herein after but those skilled in the art will understand that virtually the entire spectrum of ballast moving can be performed with the device in accordance with the present invention in a very simple and straight-forward fashion.

The machine, as best shown in FIG. 2, can be assumed to be moving from right to left in the direction of the arrow with both sub-frames 31*a* and 31*b* lowered so that the elements 40, 41, 42 and 43 engage the ballast and each tunnel spans its respective rail R. If ballast has been dumped on the left hand side of the track, that is to say at the bottom of FIG. 2 and it is desired to move that ballast to the right hand side of the track, that is to the top of FIG. 2, then gate 40*g* would be closed, gate 43*g* would be opened and gate 42*g* would be closed. If the reverse were true and if the ballast had been dumped on the right hand side of the track and was required to be moved to the left then gate 43*g* would be closed, gate 40*g* would be opened and gate 41*g* would be closed. If it were desired to move ballast dumped centrally of the track to the sides thereof, then gate 40*g* and gate 43*g* would be opened and gate 41*g* and 42*g* would be closed, then as the machine 10 proceeds from right to left, ballast would pass through gates 40*g* and 43*g* and would move outwardly along element 41 and 42 to the side of the track. Because of the position of the flaps on the outer ends of the plow element and indeed further, where the tips are provided on the flaps, further controlling of the ballast to the requirement of the operator may be obtained. Similarly since the elements are mounted in pairs of sub-frames 31*a*,31*b* one sub-frame can be used in the operating position with the other sub-frame raised out of operating position to obtain different effects on ballast movement.

As is normal in ballast plowing machines a rotary broom 70 (FIG. 1) is mounted on a linkage 71 for movement into and out of engagement with the ballast.

What I claim as my invention is:

1. A railroad ballast plow comprising a four element plow member of substantially X shaped configuration mounted to be centrally of the track on a track travelling vehicle for vertical movement into and out of engagement with the ballast, each plow element having at its end adjacement the intersection point of the X a ballast passing gate, and means to individually open and shut each of the four gates.

2. A plow as claimed in claim 1 in which the plow elements are mounted beneath the vehicle in pairs on vertically movably sub-frames, providing a leading and trailing plow element on each side of the vehicle.

3. A plow as claimed in claim 2 in which each ballast passing gate is pivotted adjacent and along an upper edge of its respective plow element for rotation between open and closed positions.

4. A plow as claimed in claim 3 in which the means to individually open and shut each of the gates comprises a remote controlled power means operatively connected between a gate and its respective sub-frame.

5. A plow as claimed in claim 1 in which each plow element has, at its end remote from the intersection of the X, a flap rotatable in a horizontal plane about a vertical hinge line.

6. A plow as claimed in claim 5 in which each flap has an outer tip rotatable in the flap in a vertical plane about a horizontal pivot.

* * * * *